US008917875B2

(12) United States Patent
Braun et al.

(10) Patent No.: US 8,917,875 B2
(45) Date of Patent: Dec. 23, 2014

(54) METHOD FOR DRIVING LOUDSPEAKERS

(75) Inventors: Christoph Braun, Munich (DE); Thomas Duda, Duisburg (DE); Torsten Hinz, Munich (DE)

(73) Assignee: Infineon Technologies AG, Neubiberg (DE)

( * ) Notice: Subject to any disclaimer, the term of this patent is extended or adjusted under 35 U.S.C. 154(b) by 573 days.

(21) Appl. No.: 13/248,346

(22) Filed: Sep. 29, 2011

(65) Prior Publication Data

US 2012/0140930 A1 Jun. 7, 2012

(30) Foreign Application Priority Data

Sep. 30, 2010 (DE) ..... 10 2010 047 129

(51) Int. Cl.
*H04R 5/00* (2006.01)
*H04S 5/00* (2006.01)

(52) U.S. Cl.
CPC ..... *H04S 5/00* (2013.01); *H04S 2400/07* (2013.01)
USPC ..... 381/17; 381/27; 381/306; 381/337; 381/345; 381/423; 381/432; 381/431; 381/338; 381/332; 381/333; 381/350; 181/183; 181/199

(58) Field of Classification Search
USPC ..... 381/27, 306, 337, 345, 423, 432, 431, 381/338, 332, 333, 350; 181/183, 199
See application file for complete search history.

(56) References Cited

U.S. PATENT DOCUMENTS 3,417,203 A * 12/1968 Hafler ..... 381/27
5,181,247 A * 1/1993 Holl ..... 381/306
5,307,418 A * 4/1994 Sumitani ..... 381/307
6,313,697 B1 * 11/2001 Neuteboom et al. ..... 330/10
6,438,237 B1 * 8/2002 Nakamura ..... 381/27
6,529,787 B2 3/2003 Weikel et al.
6,782,111 B1 * 8/2004 Wagner et al. ..... 381/335
7,130,346 B2 * 10/2006 Midya et al. ..... 375/238
7,382,887 B2 6/2008 Brodkin
7,542,815 B1 * 6/2009 Berchin ..... 700/94
8,014,533 B2 * 9/2011 Felder ..... 381/17

(Continued)

FOREIGN PATENT DOCUMENTS

CN 2733796 Y * 6/2004
CN 102075833 B * 12/2012
DE 34 16 494 A1 11/1985

OTHER PUBLICATIONS

Wayne, How to install a center channel, 1990.*

*Primary Examiner* — Davetta W Goins
*Assistant Examiner* — Kuassi Ganmavo
(74) *Attorney, Agent, or Firm* — Slater & Matsil, L.L.P.

(57) ABSTRACT

A circuit for operating loudspeakers includes a first, second, third and fourth loudspeaker circuit, having one input each for injecting a signal and one output each for connecting a loudspeaker input. The loudspeaker circuits are designed to amplify the injected signal and to provide the amplified signal at the outputs thereof. The loudspeaker circuits can, for example, be used for a 2.1 sound system. The three channels for a 2.1 sound system can be implemented by an amplifier circuit with four loudspeaker circuits, one loudspeaker circuit each being required for the two stereo channels left and right. A subwoofer channel can be driven differentially by two loudspeaker circuits. The stereo channels are, by contrast, only still connected to one loudspeaker circuit each, and so the stereo channels require at least one further common ground cable.

26 Claims, 3 Drawing Sheets

(56) References Cited

U.S. PATENT DOCUMENTS

2004/0086128 A1* 5/2004 Risch et al. ..... 381/1
2010/0086136 A1 4/2010 Beckmann et al.
2012/0099742 A1* 4/2012 Edeler ..... 381/120

* cited by examiner

METHOD FOR DRIVING LOUDSPEAKERS

This application claims priority to German Patent Application 10 2010 047 129.1, which was filed Sep. 30, 2010 and is incorporated herein by reference.

TECHNICAL FIELD

The present invention relates to a circuit for driving loudspeakers.

BACKGROUND

Various types of drives are used to drive loudspeakers. A simple type of drive is to drive each loudspeaker with a driver circuit via two cables. Thus, in the case of a simple drive with one driver circuit one cable with an audio signal is laid for the loudspeaker, while in this instance the other cable is the common ground (e.g., earth ground) of the loudspeaker and the driver circuit. A loudspeaker can be driven differentially by connecting the second cable not to a common ground, but to a second driver circuit.

The advantages of the simple drive over the differential drive are that fewer driver circuits are required, the result thus being that there is also a cost advantage of the simple drive over the differential drive. In the case of a simple drive, a plurality of loudspeakers can be operated with a common ground line. The outlay on the cabling can thereby be lowered, and so a further cost advantage is attained. A common ground line of a plurality of loudspeakers has the disadvantage, however, that each loudspeaker is disadvantageously influenced by the audio signals of the respective other loudspeakers owing to the common ground line. Particularly in the case of driver circuits which operate the loudspeakers with a bivalent signal, so called class D amplifiers, this leads to an audible deterioration in the acoustic signal output by the loudspeakers. A differential drive avoids this disadvantage by virtue of the fact that each loudspeaker is driven separately. However, this has the disadvantage of substantially higher costs.

SUMMARY OF THE INVENTION

An embodiment of the present invention provides a method for operating loudspeakers with a low outlay on loudspeaker drivers and cables, and provides the loudspeakers with an audio signal that exhibits a low mutual influence.

In an embodiment method for operating three loudspeakers having a provided stereo audio signal with one audio signal each for a right and a left channel, a third audio signal is extracted from the stereo audio signal. A drive signal of the left channel is produced for a loudspeaker connection from the audio signal for the left channel. A drive signal of the right channel is produced for a loudspeaker connection from the audio signal for the right channel. A first drive signal of the third audio signal is produced for a first loudspeaker connection. A second drive signal of the third audio signal is produced for a second loudspeaker connection. From the third audio signal, a first loudspeaker of the three loudspeakers is driven at a first loudspeaker connection with the drive signal of the left channel and the first drive signal of the third audio signal. The first loudspeaker of the three loudspeakers is driven at a second loudspeaker connection with the first drive signal of the third audio signal. A second loudspeaker of the three loudspeakers is driven at a first loudspeaker connection with the first drive signal of the third audio signal. The second loudspeaker of the three loudspeakers is driven at a second loudspeaker connection with the second drive signal of the third audio signal. A third loudspeaker of the three loudspeakers is driven at a first loudspeaker connection with the drive signal of the right channel and the second drive signal of the third audio signal. The third loudspeaker of the three loudspeakers is driven at a second loudspeaker connection with the second drive signal of the third audio signal.

This embodiment method can be used, for example, for a 2.1 sound system. The third channel for a 2.1 sound system, for example, a subwoofer channel, can be extracted from the audio signals of the left and right channels. The subwoofer channel can be driven by two drive signals in a fully differential fashion. The left and right stereo channels are, by contrast, driven only with one drive signal in each case. The second connection of the loudspeaker for the left and right stereo channels is made at in each case one connection of the loudspeaker for the subwoofer. This connection acts for the loudspeaker of the left and right channels like a virtual ground connection. The loudspeakers for the left and right channels are driven in a pseudo-differential fashion with this method. In the case of this method, the third audio signal acts like a common mode signal on the loudspeakers for the left and right channels, and therefore causes no deflections of any sort of the loudspeakers for the left and right channels.

In an embodiment method for operating three loudspeakers, the drive signal of the left channel, the drive signal of the right channel and the first and the second control signals of the third audio signal are signals with a bivalent level.

A bivalent drive signal can comprise, for example, the levels of positive and negative supply voltages, or supply voltage and ground. Audio systems which use a bivalent level to drive the loudspeakers are denoted as class D systems.

In an embodiment method for operating three loudspeakers, the drive signal of the left channel, the drive signal of the right channel and the first and the second drive signals of the third audio signal are pulse-width modulated signals.

In an embodiment method for operating three loudspeakers, the pulse width of the pulse-width modulated signal is a specific pulse-width value from a specific and bounded set of defined pulse-width values.

In an embodiment method for operating three loudspeakers, the third audio signal is extracted from the stereo audio signal in such a way that the third audio signal is a complement of the stereo audio signal.

With the aid of this embodiment drive by the drive signals, it is possible to achieve an uncorrupted audio signal at the outputs of the loudspeaker circuits, and thus a faithful reproduction of the audio signals by the loudspeaker per se. Complementary means that the addition of the third audio signal to the left or right audio signal leads to a linear transfer function. This method avoids overdriving the PWM.

In an embodiment method for operating three loudspeakers, the first drive signal of the third audio signal is a complement of the drive signal of the left channel, and the second drive signal of the third audio signal is a complement of the drive signal of the right channel.

BRIEF DESCRIPTION OF THE DRAWINGS

Embodiments are explained in more detail below with reference to the following drawings.

DETAILED DESCRIPTION OF ILLUSTRATIVE EMBODIMENTS

Figure 1:
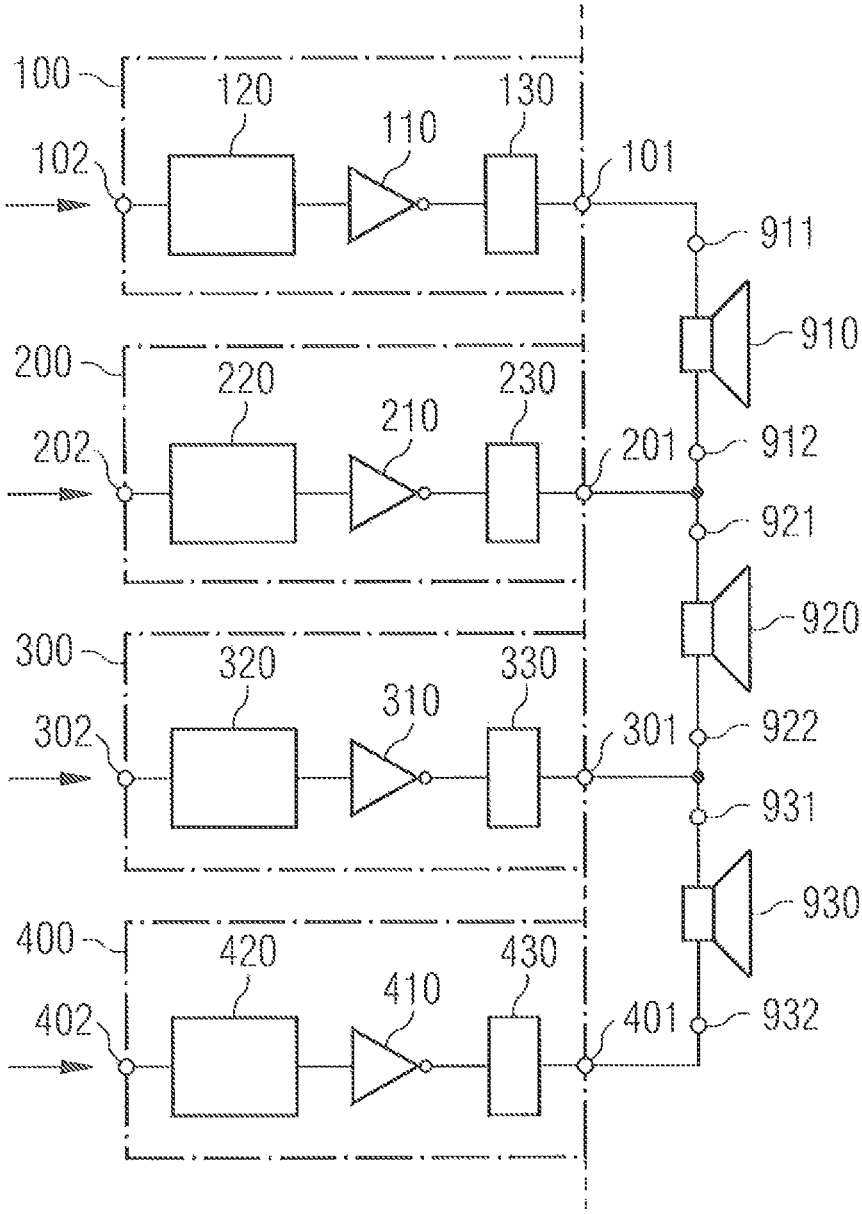
FIG. 1 shows a circuit for operating loudspeakers.

In general, an embodiment circuit for operating loudspeakers having a provided audio signal comprises a first, second, third and fourth loudspeaker circuit, having one input each and one output each for connecting a loudspeaker input, the loudspeaker circuits being designed to amplify the injected signal and to provide the amplified signal at the outputs thereof. The loudspeaker circuits can, for example, be used for a 2.1 sound system. The three channels for a 2.1 sound system can be implemented by an amplifier circuit with four loudspeaker circuits, one loudspeaker circuit each being required for the two stereo channels left and right. A subwoofer channel can be driven differentially by two loudspeaker circuits. The left and right stereo channels are, by contrast, only still connected to one loudspeaker circuit each. The second connection of the loudspeaker for the left and right stereo channels is made at in each case one connection of the loudspeaker for the subwoofer. This connection acts for the loudspeaker of the left and right channels and the respective loudspeaker circuits like a virtual ground connection.

If digital, non-differential and/or single-phase class D amplifiers are used in the case of which the loudspeaker drivers of the loudspeaker circuit are not located in a feedback loop of the overall circuit, the result is a poorer rejection of the power supply interference (Power Supply Rejection, PSR or PSSR), since in comparison with the differential class D amplifiers, the additive interference component is not rejected. In the case of differential or pseudo-differential class D amplifiers, the interference signal is converted into a common mode signal so that the load, or the loudspeaker, does not perceive the additive interference.

A 2.1 sound system has three loudspeakers, a first loudspeaker reproducing a first audio signal. The first audio signal can be the audio signal of a right channel. A second loudspeaker can reproduce a second audio signal. The second audio signal can be the audio signal of a left channel. A third loudspeaker can reproduce a third audio signal. The third audio signal can be the audio signal of a subwoofer channel.

The first loudspeaker can be connected to a first loudspeaker connection at the output of the first loudspeaker circuit, and with its second loudspeaker connection to the connection of the second loudspeaker circuit. The second loudspeaker can be connected to a first loudspeaker connection at the output of the third loudspeaker circuit, and with its second loudspeaker connection to the connection of the fourth loudspeaker circuit. The third loudspeaker can be connected to a first loudspeaker connection at the output of the second loudspeaker circuit, and with its second loudspeaker connection to the connection of the third loudspeaker circuit. The first and the second loudspeakers therefore have a common connection each to a loudspeaker circuit.

Owing to a particular provision of the audio signals at the inputs of the loudspeaker circuits, it is possible to achieve an uncorrupted audio signal at the outputs of the loudspeaker circuits, and thus a faithful reproduction of the audio signals by the loudspeaker per se.

The circuit for operating loudspeakers can provide at the input of the first loudspeaker circuit a first audio signal and a first part of a third audio signal, the second loudspeaker circuit can provide at its input the first part of the third audio signal, the third loudspeaker circuit can provide at its input a second part of the third audio signal, and the fourth loudspeaker circuit can provide at its input a second audio signal and the second part of the third audio signal.

The effect of this circuit is that the third loudspeaker, the loudspeaker that reproduces the third audio signal, or the subwoofer signal, is driven fully differentially with the third audio signal. Since this loudspeaker is driven solely with the third audio signal, the reproduction of the third audio signal is not disturbed by the third loudspeaker.

This circuit equally has the effect that the first loudspeaker, which reproduces the first audio signal, or the right channel of the stereo signal, is driven in a pseudo-differential fashion with the first audio signal. The third audio signal is provided, via the first and the second loudspeaker circuits, to the first loudspeaker in the same way at the outputs of the first and the second loudspeaker circuits such that the third audio signal acts on the loudspeaker like a common mode signal, and therefore causes no deflections of any sort of the loudspeaker. The output of the second loudspeaker circuit therefore acts on the first loudspeaker like a virtual ground connection.

This circuit equally has the effect that the second loudspeaker, which reproduces the second audio signal, or the left channel of the stereo signal, is driven in a pseudo-differential fashion with the second audio signal. The third audio signal is provided, via the third and the fourth loudspeaker circuits, to the second loudspeaker in the same way at the outputs of the third and the fourth loudspeaker circuits such that the third audio signal acts on the loudspeaker like a common mode signal, and therefore causes no deflections of any sort of the loudspeaker. The output of the third loudspeaker circuit therefore acts on the second loudspeaker like a virtual ground connection.

The first and the second loudspeakers are driven by the circuit in a pseudo-differential fashion. The first and the fourth loudspeaker circuits drive the loudspeakers actively. The second and the third loudspeaker circuits act at their outputs on the loudspeakers like a virtual ground connection. The third audio signal is superimposed on the audio signals of the loudspeaker circuits in such a way that it acts on the first and second loudspeakers like a common mode signal via the outputs of the loudspeaker circuits. The first and the second loudspeaker circuits are superimposed thereby on the first part of the third audio signal, which is suitable for driving the first connection of the third loudspeaker. The second part of the third audio signal, which is suitable for driving the second connection of the third loudspeaker is in this case superimposed on the third and the fourth loudspeaker circuits.

Loudspeaker circuits of the circuit for operating loudspeakers can comprise one loudspeaker driver each with one output each which is connected to the output of the loudspeaker circuit, the loudspeaker driver providing at its outputs a signal with a bivalent level.

A bivalent drive signal can comprise, for example, the levels of positive and negative supply voltages, or supply voltage and ground. The loudspeaker driver can therefore, by way of example, be designed as a simple half bridge, the half bridge having two switches which are configured in such a way that the output of the loudspeaker driver can be switched to the first or to the second level.

Audio systems which use a bivalent level to drive the loudspeakers are denoted as class D systems.

The loudspeaker circuits of the circuit for operating loudspeakers can comprise one pulse width modulator each, having one output each and one input each. The respective input of the pulse width modulator is connected to the respective input of the loudspeaker circuit. The respective output of the pulse width modulator is connected to the respective input of the loudspeaker driver. The pulse width modulators provide a pulse-width modulated signal at their outputs. By way of example, such a pulse-width modulated signal can be provided by the pulse width modulator by virtue of the fact that the pulse width modulator samples the signal at its input and, for example, determines a pulse width with the aid of a comparator. The pulse width can assume any desired value in such a pulse-width modulated system.

The pulse-width modulator of the circuit for operating loudspeakers can provide one pulse width, the pulse width being a specific pulse width value from a specific and bounded set of defined pulse width values. The set of defined pulse width values can, for example, comprise $2^n$ values, the result being $2^1-1$ intervals. These pulse width values can have an equal temporal spacing.

The circuit for operating loudspeakers can have a filter for converting signals. The filter has at least one input and a first, second, third and fourth output. The first to fourth outputs of the filter is connected to the respective input of the first to fourth loudspeaker drivers. The filter is provided at its input with a first and a second audio signal. The filter uses the first and the second audio signals to produce the third audio signal and to provide it at its outputs.

The filter of the circuit for operating loudspeakers can extract the third signal from the first and the second signals in such a way that the third signal is a complement of the first and the second signals.

The filter of the circuit for operating loudspeakers can extract the first part of the third signal from the first signal, and extract the second part of the third signal from the second signal in such a way that the first part of the third signal is a complement of the first signal, and that the second part of the third signal is a complement of the second signal.

The filter of the circuit can split a stereo PCM signal into a left and right as well as into a subwoofer signal. After this splitting, the audio signals may be supplied to the corresponding pulse width modulators of the loudspeaker circuits.

The pulse width modulators of the loudspeaker circuits for the stereo channels respectively receive a superimposed PCM signal from the respective channel and the subwoofer signal, such that the loudspeakers which can be connected for the channels receive the superimposed subwoofer signal as common mode signal. This superimposition leads to the extinction of the subwoofer signals in the left and right channels. The result at the outputs of the loudspeaker circuits and at the loudspeakers is a pseudo-differential class D signal without subwoofer components. The subwoofer loudspeaker can be driven fully differentially.

In order to avoid overdriving in the PWM modulators, the separation of the subwoofer signal and the signals of the right or the left channels can be performed with a complementary filter structure. Complementary means that the addition of the subwoofer signal to the left or right audio signal leads to a linear transfer function.

The method for operating three loudspeakers converts a provided stereo audio signal which has an audio signal for a right and a left channel in such a way as to extract from the provided stereo audio signal a third audio signal which can be used to operate a subwoofer loudspeaker. The third audio signal is added to the audio signals for the left and right channels.

A third loudspeaker is driven with the third audio signal in a fully differential fashion. A virtual reference point is provided for the first and the second loudspeakers with the aid in each case of a connection of the third loudspeaker.

A first loudspeaker is driven in a pseudo-differential fashion with the audio signal for the right channel and the third audio signal.

A second loudspeaker is driven in a pseudo-differential fashion with the audio signal for the left channel and the third audio signal.

The provided stereo audio signal and the third audio signal are converted into PWM signals in the method for operating three loudspeakers.

In the method for operating three loudspeakers, the third audio signal is extracted from the provided stereo audio signal in such a way that the third audio signal is a complement of the provided stereo audio signal.

FIG. 1 shows a circuit for operating loudspeakers 910, 920, 930 having four loudspeaker circuits 100, 200, 300, 400 and the loudspeakers 910, 920, 930 which can be connected, the loudspeaker circuits having one pulse width modulator 120, 220, 320, 420 each, one loudspeaker driver 110, 210, 310, 410 each, and one filter 130, 230, 330, 430 each. Three loudspeakers 910, 920, 930 have connections 911, 912, 921, 922, 931, 932 connected to the respective outputs 101, 201, 301, 401 as shown in FIG. 1. Provided at the input 102 of the first loudspeaker circuit 100 is an audio signal which is composed of an audio signal of the right audio signal and an audio signal of the subwoofer channel. Provided at the inputs 202, 302 of the second and third loudspeaker circuits 200, 300 is an audio signal which includes the audio signal of the subwoofer channel. Provided at the input 402 of the fourth loudspeaker circuit 400 is an audio signal which is composed of an audio signal of the left audio signal and an audio signal of the subwoofer channel.

Figure 2:
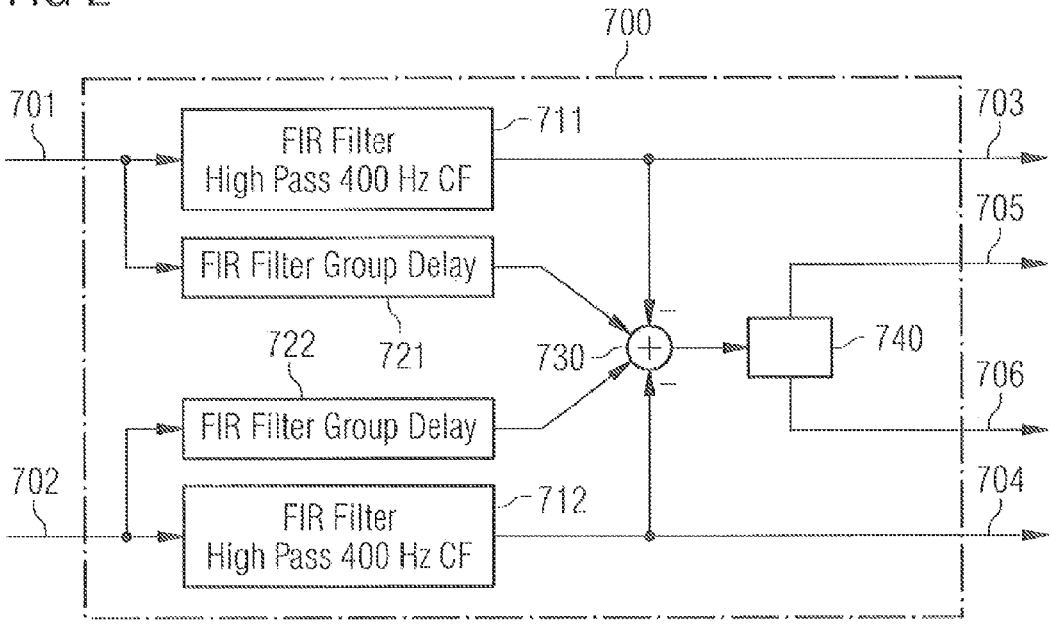
FIG. 2 shows an example embodiment of a filter for complementary separation of a subwoofer signal.

FIG. 2 shows an example embodiment of a filter 700 for complementary separation of a subwoofer signal from the right and left channel signals. This example embodiment has two high-pass FIR filters 711, 712 with a high-pass frequency of 400 Hz, two group delay elements 721, 722, a summer 730 and a splitter 740. The high-pass filter FIR filters 711, 712 filter the high-pass signal components from the audio signals of the right and left audio signals, and provide these audio signals at the outputs 703, 704. The group delay elements 721, 722 provide the right and the left audio channels with the same delay time as have the audio signals at the outputs of the high-pass FIR filters 711, 712. All four audio signals are fed to the summer 730, all four audio signals having the same propagation time delay, and the audio signals at the outputs of the high-pass FIR filters 711, 712 being subtracted such that the subwoofer signal is provided at the output of the summer 730. Subsequently, the splitter 740 halves the amplitude of the subwoofer signal and provides a non-inverted part 705 and inverted part 706 of the audio signal for differential driving of a loudspeaker.

By way of example, the low-frequency subwoofer signal can be separated with a linear-phase FIR filter 711, 712 from a stereo signal 701, 702 on the right and left channels. In this example embodiment, a filter frequency of 400 Hz is applied in the linear-phase FIR filters 711, 712. The subwoofer signal is then produced by subtracting the right and left stereo input signals. It can be ensured thereby that the digital pulse width modulators of the loudspeaker circuits are not overdriven when the latter are designed for the maximum stereo input signal. What then results is a maximum modulation degree in conjunction with a maximum level of the stereo input signal.

When the separation of the audio signals is not performed in an entirely complementary fashion, this leads to a reduced driving of the pulse width modulators of the loudspeaker circuits, and thus to a lower modulation degree. The separation should therefore be performed as far as possible with linear-phase filter structures.

The splitter 740 in FIG. 2 halves the amplitude. This is necessary because the subwoofer signal is produced from the superimposition of the two stereo channels.

Figure 3:
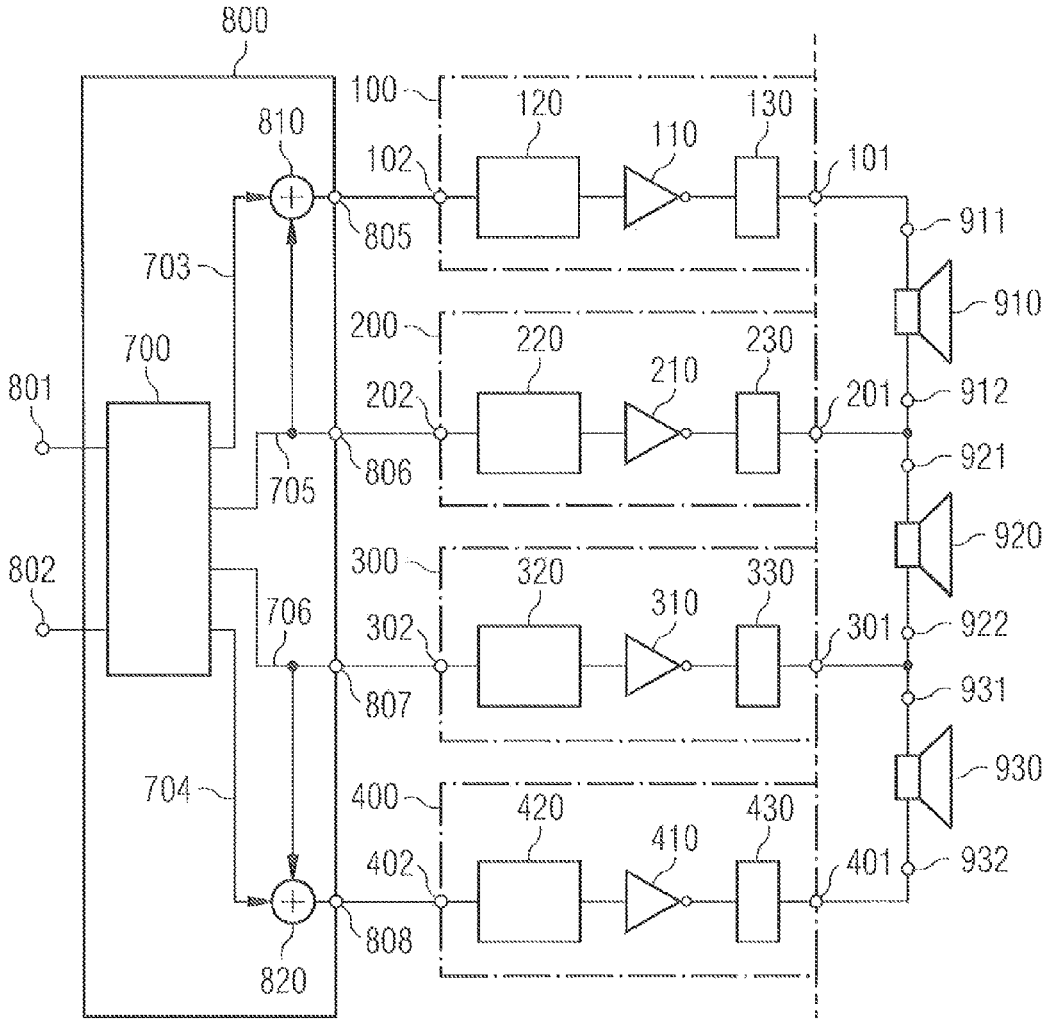
FIG. 3 shows an example embodiment of a filter for converting and for providing the audio signals on a circuit for operating loudspeakers.

FIG. 3 shows an example embodiment of a filter for converting and for providing the audio signals on a circuit for operating loudspeakers. The filter 800 for converting signals has two inputs 801, 802 and four outputs 805, 806, 807, 808. The audio signals can be provided at the inputs 801, 802 of filter 800. By way of example, this can be an audio signal with a right and left channel. The inputs can be connected to a circuit 700 for complementary separation. The filter has two summing circuits 810, 820, in which the signals of the first 703 and second 705 outputs of the circuit 700 are summed for complementary separation, and are provided at the first output 805, and the audio signals on the third 706 and fourth 704 outputs of the circuit 700 are summed for complementary separation and provided at the fourth output 808. The audio signals of the second 705 and third 706 outputs of the circuit 700 are provided unchanged for complementary separation at the second 806 and the third outputs 807.

What is claimed is:

1. A method for operating three loudspeakers based on a provided stereo audio signal with one audio signal each for a right channel and a left channel, the method comprising:

extracting a third audio signal from the stereo audio signal using an audio separation circuit;

producing a drive signal of the left channel from the audio signal for the left channel using a first audio circuit;

producing a drive signal of the right channel from the audio signal for the right channel using a second audio circuit;

producing a first drive signal of the third audio signal from the third audio signal using a third audio circuit;

producing a second drive signal of the third audio signal produced from the third audio signal using a fourth audio circuit;

driving a first loudspeaker of the three loudspeakers at a first loudspeaker connection of the first loudspeaker with the drive signal of the left channel and the first drive signal of the third audio signal;

driving the first loudspeaker of the three loudspeakers at a second loudspeaker connection of the first loudspeaker with the first drive signal of the third audio signal;

driving a second loudspeaker of the three loudspeakers at a first loudspeaker connection of the second loudspeaker with the first drive signal of the third audio signal;

driving the second loudspeaker of the three loudspeakers at a second loudspeaker connection of the second loudspeaker with the second drive signal of the third audio signal;

driving a third loudspeaker of the three loudspeakers at a first loudspeaker connection of the third loudspeaker with the drive signal of the right channel and the second drive signal of the third audio signal; and driving the third loudspeaker of the three loudspeakers at a second loudspeaker connection of the third loudspeaker with the second drive signal of the third audio signal.

2. The method for operating the three loudspeakers according to claim 1, wherein the drive signal of the left channel, the drive signal of the right channel and the first and the second drive signals of the third audio signal are signals with a bivalent level.

3. The method for operating the three loudspeakers according to claim 2, wherein the drive signal of the left channel, the drive signal of the right channel and the first and the second drive signals of the third audio signal are pulse-width modulated signals.

4. The method for operating three loudspeakers according to claim 3, wherein the third audio signal is extracted from the provided stereo audio signal in such a way that the third audio signal is a complement of the provided stereo audio signal.

5. The method for operating the three loudspeakers according to claim 4, wherein the first drive signal of the third audio signal is a complement of the drive signal of the left channel, and the second drive signal of the third audio signal is a complement of the drive signal of the right channel.

6. The method for operating the three loudspeakers according to claim 3, wherein the first drive signal of the third audio signal is a complement of the drive signal of the left channel, and the second drive signal of the third audio signal is a complement of the drive signal of the right channel.

7. The method for operating three loudspeakers according to claim 2, wherein the third audio signal is extracted from the provided stereo audio signal in such a way that the third audio signal is a complement of the provided stereo audio signal.

8. The method for operating the three loudspeakers according to claim 7, wherein the first drive signal of the third audio signal is a complement of the drive signal of the left channel, and the second drive signal of the third audio signal is a complement of the drive signal of the right channel.

9. The method for operating the three loudspeakers according to claim 2, wherein the first drive signal of the third audio signal is a complement of the drive signal of the left channel, and the second drive signal of the third audio signal is a complement of the drive signal of the right channel.

10. The method for operating the three loudspeakers according to claim 1, wherein the drive signal of the left channel, the drive signal of the right channel and the first and the second drive signals of the third audio signal are pulse-width modulated signals.

11. The method for operating the three loudspeakers according to claim 10, wherein a pulse width of the pulse-width modulated signal is a specific pulse-width value from a specific and bounded set of defined pulse-width values.

12. The method for operating three loudspeakers according to claim 11, wherein the third audio signal is extracted from the provided stereo audio signal in such a way that the third audio signal is a complement of the provided stereo audio signal.

13. The method for operating the three loudspeakers according to claim 12, wherein the first drive signal of the third audio signal is a complement of the drive signal of the left channel, and the second drive signal of the third audio signal is a complement of the drive signal of the right channel.

14. The method for operating the three loudspeakers according to claim 11, wherein the first drive signal of the third audio signal is a complement of the drive signal of the left channel, and the second drive signal of the third audio signal is a complement of the drive signal of the right channel.

15. The method for operating three loudspeakers according to claim 10 wherein the third audio signal is extracted from the provided stereo audio signal in such a way that the third audio signal is a complement of the provided stereo audio signal.

16. The method for operating the three loudspeakers according to claim 15, wherein the first drive signal of the third audio signal is a complement of the drive signal of the left channel, and the second drive signal of the third audio signal is a complement of the drive signal of the right channel.

17. The method for operating the three loudspeakers according to claim 10, wherein the first drive signal of the third audio signal is a complement of the drive signal of the left channel, and the second drive signal of the third audio signal is a complement of the drive signal of the right channel.

18. The method for operating the three loudspeakers according to claim 1, wherein the third audio signal is extracted from the provided stereo audio signal in such a way that the third audio signal is a complement of the provided stereo audio signal.

19. The method for operating the three loudspeakers according to claim 18, wherein the first drive signal of the third audio signal is a complement of the drive signal of the left channel, and the second drive signal of the third audio signal is a complement of the drive signal of the right channel.

20. The method for operating the three loudspeakers according to claim 1, wherein the first drive signal of the third audio signal is a complement of the drive signal of the left channel, and the second drive signal of the third audio signal is a complement of the drive signal of the right channel.

21. The method for operation the three loudspeakers according to claim 1, wherein:

using the audio separation circuit comprises using a FIR filter;

using the first audio circuit comprises using a first pulse-width modulator;

using the second audio circuit comprises using a second pulse-width modulator;

using the third audio circuit comprises using a third pulse-width modulator; and using the fourth audio circuit comprises using a fourth pulse-width modulator.

22. An audio system comprising:

an audio processing circuit configured to be coupled to a right channel input terminal and a left channel input terminal, the audio processing circuit configured to produce a first center channel signal at a second output node, the first center channel signal based on a right input channel signal of the right channel input terminal and a left channel input signal of the left channel input terminal, produce second center channel signal at a third output node, the second center channel signal based on the right input channel signal and the left channel input signal, wherein the second center channel signal has an opposite phase of the first center channel signal, produce a left channel output signal at a first output node, the left channel output signal comprising a sum of the left channel input signal and the second center channel signal, and produce a right channel output signal at a fourth output node, the right channel output signal comprising a sum of the right channel input signal and the first center channel signal;

a first loudspeaker driving circuit having an input coupled to the first output node of the audio processing circuit and a first output terminal configured to be coupled to a first terminal of a first loudspeaker;

a second loudspeaker driving circuit having an input coupled to the second output node of the audio processing circuit and having a second output terminal configured to be coupled to a second terminal of the first loudspeaker and to a first terminal of a third loudspeaker;

a third loudspeaker driving circuit having an input coupled to the third output node of the audio processing circuit and having a third output terminal configured to be coupled to a second terminal of the third loudspeaker and to a first terminal of a second loudspeaker; and a fourth loudspeaker driving circuit having an input coupled to the fourth output node of the audio processing circuit and having a fourth output terminal configured to be coupled to a second terminal of the second loudspeaker.

23. The audio system of claim 22, further comprising the first loudspeaker, the second loudspeaker and the third loudspeaker.

24. The audio system of claim 22, wherein the audio processing circuit comprises:

a first high-pass filter configured to filter the right channel input signal;

a second high-pass filter configured to filter the left channel input signal; and a summing circuit configured to produce the first center channel signal and second center channel signal by summing the right channel input signal, an output of the first high-pass filter, the left channel input signal, and an output of the second high-pass filter.

25. The audio system of claim 24, further comprising a first delay circuit coupled between an input of the first high-pass filter and the summing circuit, and a second delay circuit coupled between an input of the second high-pass filter and the summing circuit.

26. The audio system of claim 22, wherein:

the first loudspeaker driving circuit comprises a first pulse-width modulator; the second loudspeaker driving circuit comprises a second pulse-width modulator;

the third loudspeaker driving circuit comprises a third pulse-width modulator; and the fourth loudspeaker driving circuit comprises a fourth pulse-width modulator.

* * * * *